United States Patent [19]

Chamberlain

[11] 4,422,436

[45] Dec. 27, 1983

[54] JACKETED WOOD STOVE

[76] Inventor: Joseph G. Chamberlain, 12350 SW. 124th, Tigard, Oreg. 97223

[21] Appl. No.: 360,425

[22] Filed: Mar. 22, 1982

Related U.S. Application Data

[63] Continuation of Ser. No. 131,214, Mar. 17, 1980, abandoned.

[51] Int. Cl.[3] ..... F24C 1/14

[52] U.S. Cl. ..... 126/61; 126/80; 126/198; 110/180

[58] Field of Search ..... 126/121, 120, 61, 63, 126/66, 67, 70, 76, 77, 123, 126, 131, 106, 112, 114, 198, 200, 80; 237/51; 110/180

[56] References Cited

U.S. PATENT DOCUMENTS

| | | | |
|---|---|---|---|
| 2,703,567 | 3/1955 | Manchester et al. | 126/121 |
| 3,190,279 | 6/1965 | Davis | 126/63 |
| 3,952,721 | 4/1976 | Patterson | 126/63 |
| 3,981,292 | 9/1976 | Lilly et al. | 126/121 |
| 4,015,581 | 4/1977 | Martenson | 126/121 |
| 4,074,679 | 2/1978 | Jensen | 126/121 |
| 4,084,572 | 4/1978 | Schettl et al. | 126/198 X |
| 4,092,976 | 6/1978 | Buckner | 126/63 |
| 4,121,560 | 10/1978 | Knight | 126/63 |
| 4,136,662 | 1/1979 | Willson | 126/77 X |
| 4,147,153 | 4/1979 | Buckner | 126/63 |
| 4,150,658 | 4/1979 | Woods | 126/63 |
| 4,166,444 | 9/1979 | Martenson | 126/121 |
| 4,170,219 | 10/1979 | Hansen et al. | 126/121 |
| 4,177,793 | 12/1979 | Johnson | 126/121 |
| 4,182,305 | 1/1980 | Johnson | 126/121 X |
| 4,224,921 | 9/1980 | Petrescue | 126/121 |
| 4,305,373 | 12/1981 | Martenson | 126/121 |

*Primary Examiner*—Samuel Scott
*Assistant Examiner*—Randall L. Green
*Attorney, Agent, or Firm*—Klarquist, Sparkman, Campbell, Leigh & Whinston

[57] ABSTRACT

A jacketed wood stove has a jacket forming an air space conformably surrounding the top, bottom, rear and sidewalls of the firebox, and a double-jacketed front access door. The periphery of the access door is slotted for internal convective cooling of the door. Ambient air enters the air space beneath the firebox, flows rearwardly, then upwardly behind the firebox and forwardly along the top and sidewalls of the firebox to progressively heat the air and to cool the outer jacket. A reflective intermediate baffle between the jacket and the side and rear walls of the firebox further cools the jacket. Heated air returns to the room via sidewardly-directed outlet slots along the upper and frontal margins of the jacket sidewalls. A pedestal supports the jacketed firebox above the floor. The pedestal contains a first conduit for introducing ambient air into the air space and second conduit for introducing outside combustion air into the firebox. The pedestal also houses a blower for blowing air into the air space. A horizontal baffle inside the firebox deflects the flames and hot gases forwardly and laterally against the firebox walls to more efficiently extract heat from the fire.

4 Claims, 8 Drawing Figures

FIG. 1
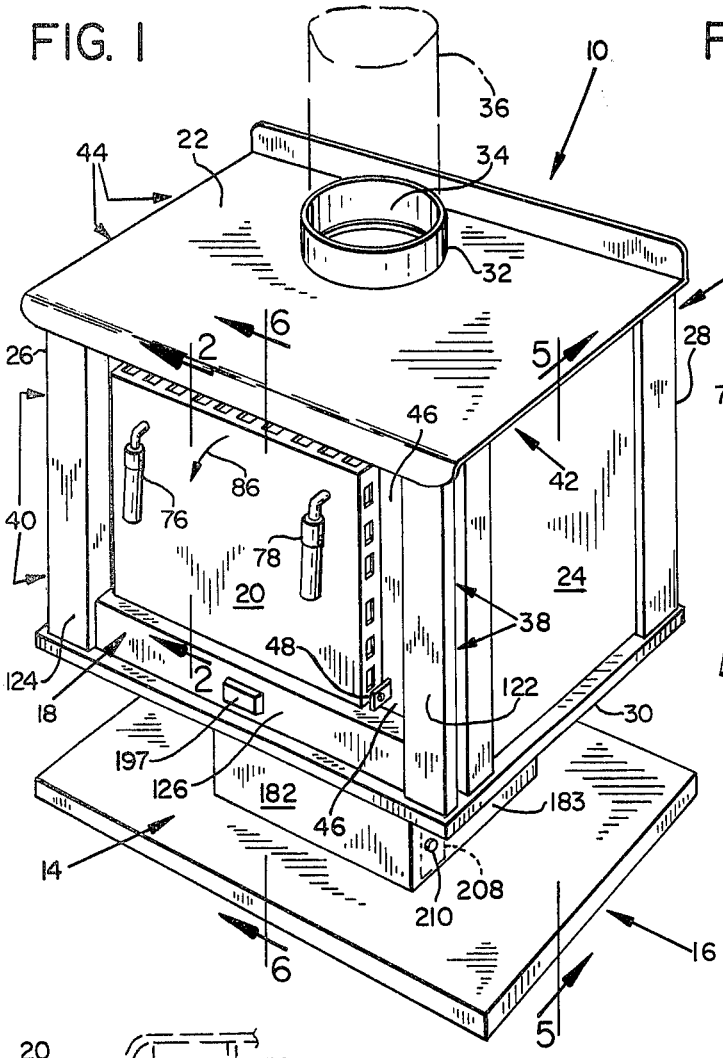
FIG. 2
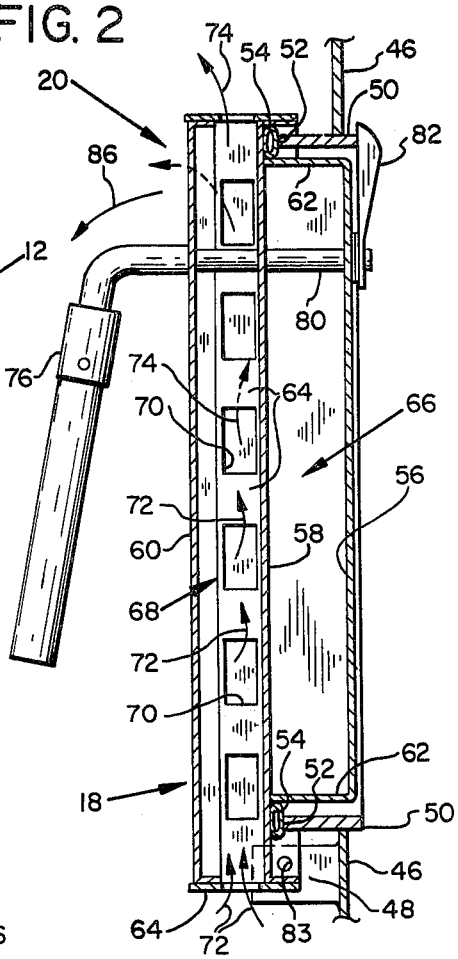
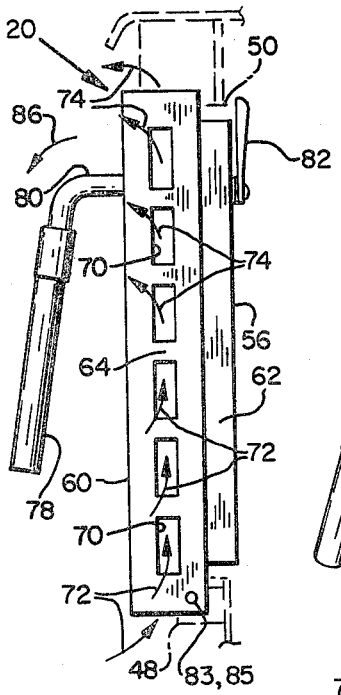
FIG. 3
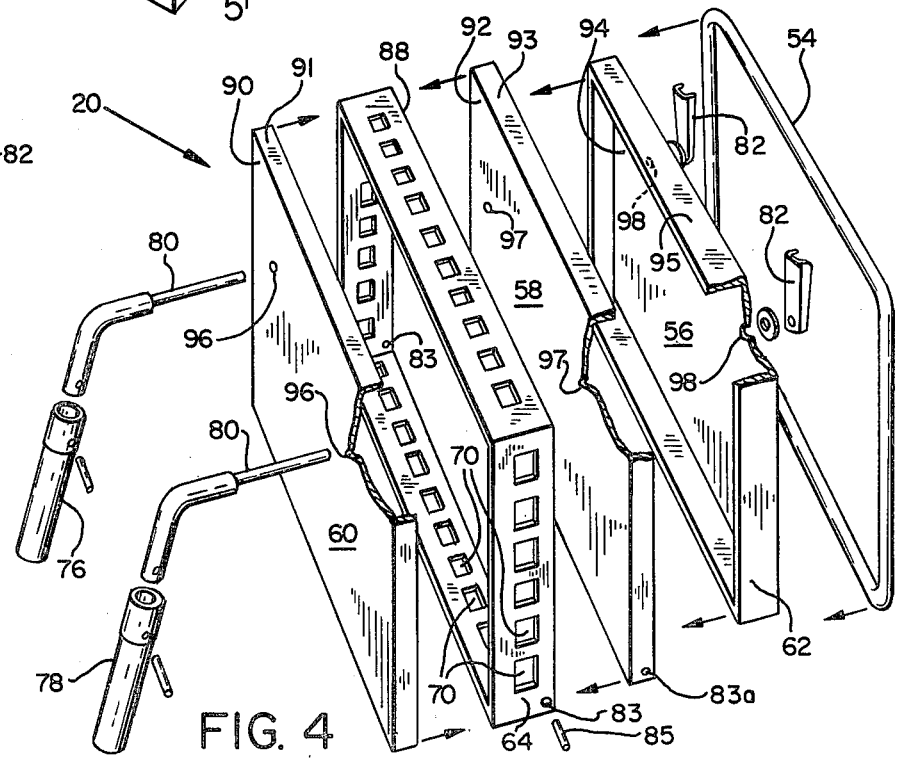
FIG. 4

FIG. 5
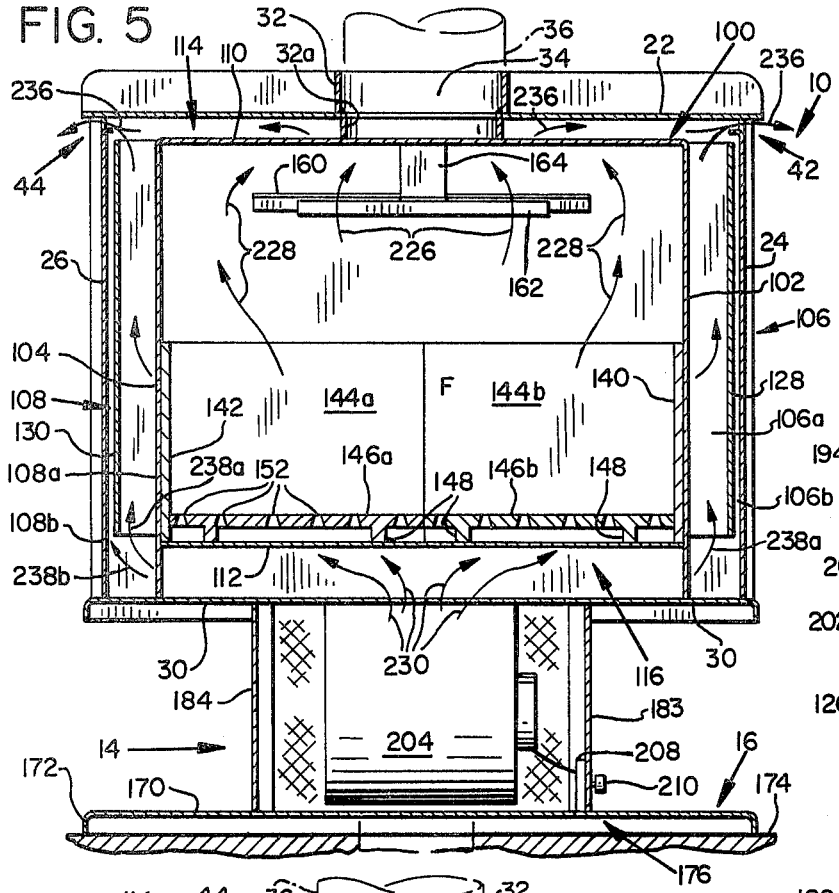
FIG. 7
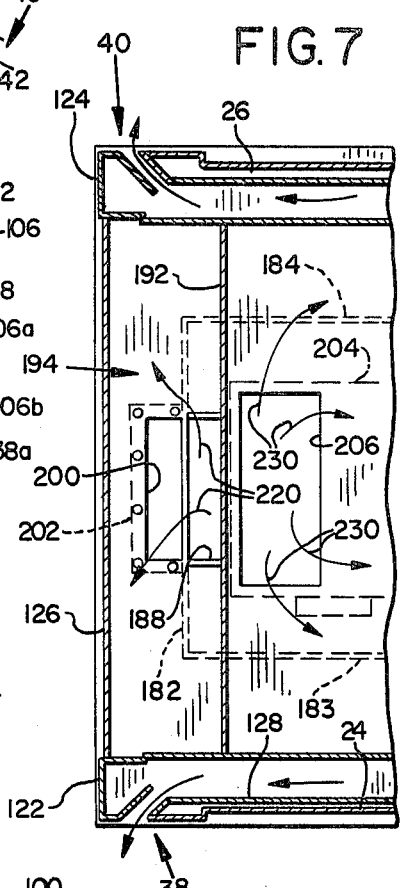
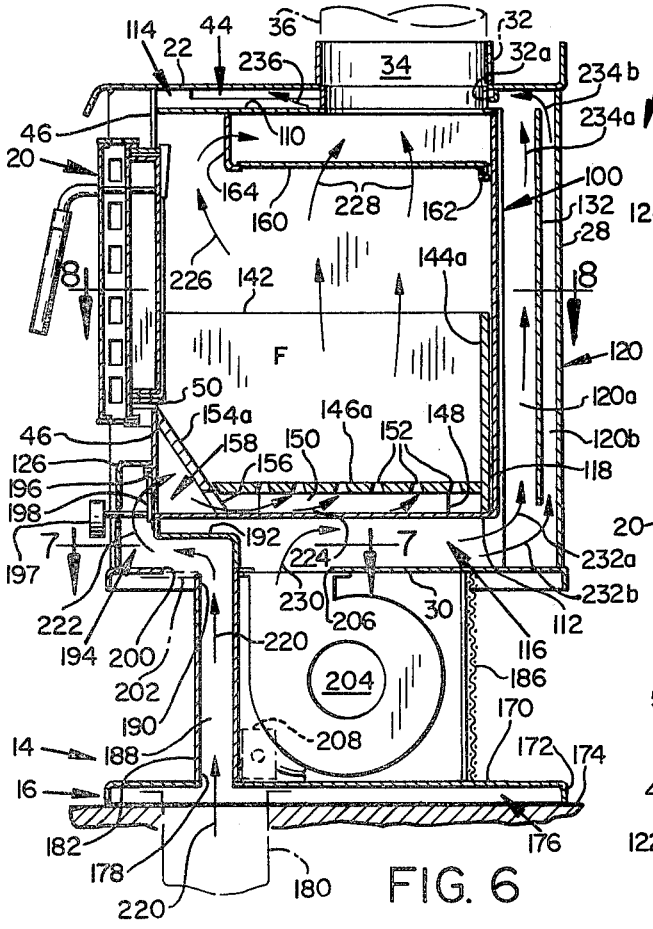
FIG. 6
FIG. 8
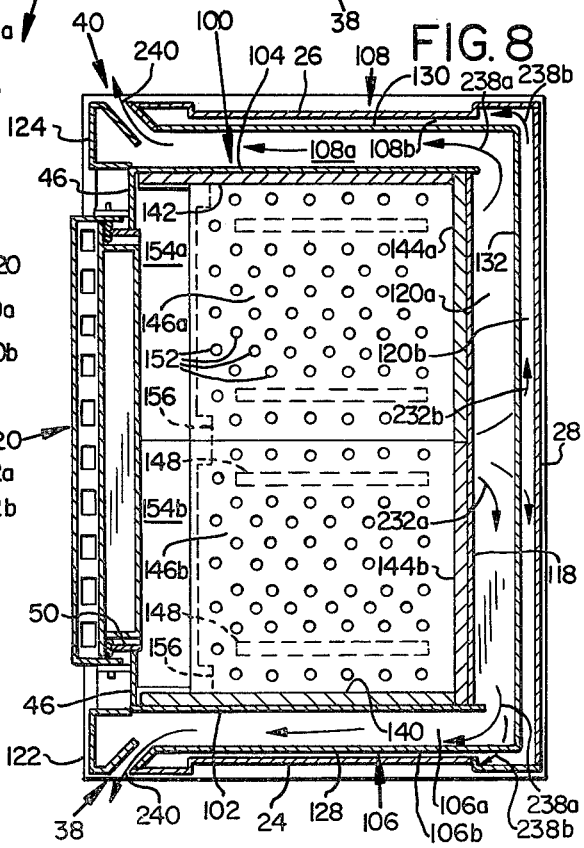

JACKETED WOOD STOVE

This is a continuation of application Ser. No. 131,214, filed Mar. 17, 1980 now abandoned.

BACKGROUND OF THE INVENTION

The invention relates generally to wood-burning furnaces and the like, and more particularly to free-standing jacketed wood stoves adapted for maximum heating efficiency and safety.

Wood-burning heating stoves have been well known for a long time. As petroleum fuel became more available in the past, usage of wood stoves declined significantly. As a result, very few homes built in the last 75 years rely on wood stoves for heating. However, recent rapid increases in petroleum fuel costs have stimulated a resurgence in interest in the use of wood as heating fuel. Fireplaces are notoriously inefficient in heating a home. Therefore, many households, even those having fireplaces, are adopting wood stoves as a principal or back-up heat source.

Because many modern homes were not originally designed to accommodate wood stoves, use of conventional wood stoves in such homes presents a serious safety hazard. Most wood stoves rely principally upon radiation for transferring heat into an associated room. Hence, they tend to have extremely hot outer surfaces, typically 300°-350° F. This presents a safety hazard to occupants of the home who might inadvertently touch the stove. As a result, the number of wood stove-related burns has increased substantially in recent years.

Conventional wood stoves also create a fire hazard if the walls and floor adjacent the stove are not adequately protected from heat radiating from the stove. Adequate protection requires that a floor beneath the stove, and any wall adjacent the stove, be made of a material that is unaffected by intense radiate heat, such as brick or stone. Use of such materials adds significantly to the cost of retrofitting a home to receive a wood stove. A less expensive alternative, asbestos sheeting, is inadequate to protect the underlying floor from heat radiated by conventional wood stoves. Such stoves often produce floor temperatures more than 200° F. above ambient temperatures. Moreover, asbestos is no longer readily available due to the recognition of health hazards in the manufacture and use of asbestos. Consequently, not realizing the dangers involved, or being unwilling to bear the additional expense, many homeowners have retrofitted their homes with wood stoves without taking adequate precautions. This has resulted in a substantial increase in home fire losses in recent years.

These safety problems are prompting more stringent regulation of wood stoves and how they are installed. Building code regulations affecting wood stoves are becoming more restrictive and are being policed more thoroughly in many parts of the country. Underwriting Laboratories (UL) standards for wood stoves were recently made more stringent as well. Compliance with the new UL standards is expected to be required in the future by both home insurers and local building regulatory agencies. Most conventional wood stoves fail to meet these standards. Hence, a wood stove capable of meeting these standards in needed.

Another problem is that existing wood stoves are generally less efficient than gas- or oil-fired heat furnaces. This is due in part to the fact that wood stoves typically heat radiatively. Consequently, a wood stove must generate more heat in order to adequately warm remote parts of the room or house in which it is situated. Also, existing wood stoves generally do not burn their fuel as completely as petroleum-fueled furnaces. A significant portion of the heat value of the wood escapes up the chimney in the form of unburnt gases. Finally, existing wood stoves are generally less efficient at extracting the heat produced by a fire. As a result, the cost advantages of burning wood over gas or oil are diminished.

An additional problem with existing wood stoves is that some of the unburnt gases condense in the chimney flue to form deposits of creosote. If creosote deposits are allowed to accumulate, a flue fire or explosion can occur. Such a fire or explosion can result in loss of the home in which the stove is situated. This danger can be avoided by cleaning the chimney flue periodically, but many existing stoves are extremely difficult to clean. It would be preferable if such deposits did not form at all. However, if such deposits do form, which is unavoidable with certain types of wood, it would be preferable if the stoves were arranged so that it would be very easy to clean the chimney flue without disconnecting and moving the stove.

A further problem is that unburnt gases emitted from the chimney pollute the air. Air pollution and smog due to burning of wood to heat homes has already become a significant problem in some areas. This problem is expected to worsen, if unchecked, as use of wood stoves increases. Consequently, several governmental air quality control agencies are investigating the possibility of regulating the use of wood stoves and the maximum level of pollutant emissions per stove. Hence, there is a need to reduce wood stove emissions of unburnt gases.

A wide variety of solutions to the above-described problems have been proposed. Many of these proposals have focused on modifying existing fireplaces to obtain some of the advantages of wood stoves without incurring excessive costs. One approach has been to install glass doors, either alone or in combination with some form of heat extractor and blower for circulating ambient air through enclosed tubes into contact with the fire or hot coals, and then expelling the air back into the room. Another approach has been to provide a jacketed fireplace insert such as those disclosed in U.S. Pat. Nos. 4,015,581 and 4,166,444 to Martenson. In such fireplace inserts, air is circulated into a jacketed airspace along the side, rear and top walls of the firebox to be warmed before returning to the room. However, such proposals fail to attain the efficiency of existing wood stoves.

Another proposed approach calls for a free-standing jacketed fireplace such as is disclosed in U.S. Pat. No. 2,703,567 to Manchester et al. This fireplace has a partially jacketed firebox and employs an upwardly inclined baffle or smoke shelf inside the firebox to deflect the flames toward the front of the firebox to radiate most of the heat forwardly into the room, rather than against the firebox walls. Consequently, little benefit is obtained from the jacketed airspace.

Another free-standing fireplace, proposed in U.S. Pat. No. 3,190,279 to Davis, has a surrounding enclosure and is mounted on a ventilated pedestal. However, the enclosure is not contoured to maximize heat extraction. It is spaced a substantial distance apart from the firebox walls so as to remain cool. A heat deflection plate inside the firebox helps to keep the firebox walls cool by deflecting the flames forwardly toward the front of the fireplace. The pedestal merely provides passive ventilation beneath the fireplace. It does nothing to contribute to the operation of the fireplace or to aid in circulating air into contact with the firebox walls.

U.S. Pat. No. 3,981,292 to Lilly et al. proposes a free-standing fireplace having heat tubes passing through an upper portion of the firebox from a plenum on one side, to outlet openings on the opposite side. A blower protruding from the rear of the fireplace blows ambient air through the plenum into the heat tubes to be heated before returning to the room. U.S. Pat. No. 4,150,658 to Woods discloses a wood stove of similar design. However, neither of these designs employs a jacket extending completely around the firebox. Moreover, the protruding blowers are unsightly and obstruct passage behind the apparatus.

Another form of wood stove is disclosed in U.S. Pat. No. 4,121,560 to Knight. The Knight patent discloses a firebox having a shield along the outer side of its rear wall and a rearwardly protruding blower mounted in an opening in the center of the shield to direct air into contact with the firebox and to circulate heated air around an associated room. However, the firebox is not completely jacketed. Its surfaces remain exposed. Also, no effort is made to maximize the efficiency of heat extraction from the firebox walls.

U.S. Pat. Nos. 4,092,976 and 4,147,153 to Buckner, disclose a partially jacketed wood stove having a blower for blowing air through an air space to hot air outlets. However, this design has several drawbacks. One drawback is the disadvantageous position of the rearwardly protruding blower. Another is that the hot radiant surfaces of the top and front walls are exposed, presenting a safety hazard. Moreover, the side and bottom walls of the jacket are likely to be too hot to safely touch or to permit positioning the stove near an unprotected wall or floor. A third drawback is that the stove requires a complex system of baffles to distribute airflow in the airspace. A fourth drawback is that the hot air outlets, positioned at the front of the stove on opposite sides of the doors, expell a concentrated blast of hot air forwardly into the room. As a result, regions along the lateral sides of the stove and at a distance therefrom are likely to be inadequately heated. Also, the air outlets are blocked whenever the doors are opened. A further drawback is that the door handles in such stoves can become too hot to touch. Simply substituting wooden handles does not solve this problem because the handles soon become scorched or charred.

U.S. Pat. No. 3,952,721 to Patterson also discloses a jacketed wood stove. This stove avoids some of the drawbacks of the Buckner design. However, the side, rear and bottom walls of the jacket are likely to become too hot to safely touch or to allow positioning of the stove near an unprotected floor or wall, but not hot enough to radiatively heat distant regions along the lateral sides of the stove. Warm air is expelled only from the front of the stove. Another drawback is that—although this design provides, to some extent, for progressive heating of air circulating through the airspace—it has no blower to take full advantage of progressive heating. Nor could such a blower be added to Patterson's design without radical changes. Finally, the hot frontal surfaces of the firebox are exposed, presenting a safety hazard. The door handle is also likely to become too hot to touch with bare hands.

Accordingly, there remains a need for a wood burning heating stove which can be safely installed and used in modern homes without incurring great expense, and which will efficiently extract heat from a wood fire and distribute the heat uniformly around the room in which the stove is situated.

SUMMARY OF THE INVENTION

It is therefore an object of the invention to improve the safety of wood stoves.

Another object of the invention is to enhance the efficiency of wood stoves.

Another object of the invention as aforementioned is to provide a more compact wood stove.

A further object of the invention is to better diffuse the hot air emitted from jacketed wood stoves, without creating high-velocity draft of hot air.

Other objects of the invention as aforementioned include:

1. Keeping the entire outer surface of the wood stove sufficiently cool so that persons inadvertently touching the stove will be not be burnt;
2. Protecting the door handles from radiant heat;
3. Reducing the amount of heat radiating laterally and rearwardly from the outer surface of the wood stove sufficiently that adjacent walls will not be damaged;
4. Reducing the temperature of the floor beneath the wood stove;
5. Obtaining more complete burning of the fuel;
6. Extracting a greater proportion of the heat produced by a fire;
7. Positioning a blower in the wood stove so that it neither gets in the way nor is exposed to excessive heating by the fire; and
8. Enabling the wood stove to use either inside or outside combustion air; and
9. Maximizing the use of progressive heating of ambient room air in the jacketed airspace.

According to the invention the jacketed wood stove has a jacket conformably surrounding the top, bottom, rear and side walls of the firebox to define an airspace. The jacketed firebox is preferably positioned on a pedestal housing air inlet means for admitting ambient air into the airspace beneath the firebox and a blower for boosting the airflow through the airspace. Ambient air entering the airspace via the inlet means flows generally upwardly around the firebox to be progressively warmed by its heat exchanging walls and to cool the jacket. Air outlet means in each side wall of the jacket discharge the heated air laterally in approximately opposite directions from the stove.

The wood stove can also include baffle means within the airspace to divide the airspace along the side and rear walls of the firebox into inner and outer portions. The baffle has a reflective inner surface for reflecting heat back into the inner portion of the airspace to further cool the rear and side walls of the jacket.

A preferred form of air outlet means includes an opening extending horizontally along an upper margin of each of the side walls of the jacket and another opening extending vertically along a frontal margin of each of the side walls.

The wood stove also preferably has a double jacketed front access door. The periphery of the door is perforated so that ambient air can enter an airspace within the door to internally convectively cool its outer surface.

The foregoing and other objects, features and advantages of the invention will become apparent from the following detailed description of a preferred embodiment of the invention, which proceeds with reference to the drawings.

BRIEF DESCRIPTION OF THE DRAWINGS

FIG. 1 is an upper, frontal perspective view of a jacketed wood stove according to the invention.

FIG. 2 is an enlarged cross-sectional view taken along line 2—2 in FIG. 1 showing a double-jacketed frontal access door according to the invention.

FIG. 3 is a side elevational view of the door of FIGS. 1 and 2.

FIG. 4 is an exploded perspective view showing the construction of the door of FIGS. 1, 2 and 3.

FIG. 5 is a vertical cross-sectional view of the wood stove of the invention taken along line 5—5 in FIG. 1.

FIG. 6 is a vertical cross-sectional view taken along line 6—6 in FIG. 1.

FIG. 7 is a horizontal cross-sectional view taken along line 7—7 in FIG. 6.

FIG. 8 is a horizontal cross-sectional view taken along line 8—8 in FIG. 6.

DETAILED DESCRIPTION OF PREFERRED EMBODIMENT

General Description

Referring to FIG. 1, a jacketed wood stove 10 according to the invention includes a rectilinear jacketed firebox 12 mounted on a pedestal 14, which is in turn supported on a laterally extending platform 16. The firebox has a rectangular frontal access opening 18 and a door 20 for closure of the opening. The jacket has a top wall 22, side walls 24, 26, rear wall 28, and bottom wall 30. A cylindrical outer collar 32 surrounds a circular opening 34 which communicates with the firebox. Collar 32 extends upwardly from top wall 22 to receive the lower end of a smoke flue 36 for exhausting smoke and gases from the firebox.

Vertical hot air outlet openings 38, 40 extend along a frontal margin of each side wall 24, 26. Similarly, horizontal air outlet openings 42, 44 extend along the upper margins of jacket side walls 24, 26.

The firebox has a front wall 46, including access opening 18, extending vertically between the top and bottom walls of the jacket. Access door 20 is connected to the front wall 46 of the firebox by means of hinges 48. Hinges 48 are positioned at the lower corners of access opening 18 so that the door can swing outwardly and downwardly for opening. Following is a detailed description of the construction of the access door.

Access Door Construction

Access door 20 is designed to provide a virtually air-tight seal within access opening 18. Referring to FIGS. 2 through 3, opening 18 includes a rectangular door frame 50 surrounding the opening. Frame 50 has parallel opposite sides connected along their outer surfaces perpendicularly to the front wall of the firebox. A principal portion of frame 50 protrudes forwardly from front wall 46 to provide a sealing flange 52 against which a gasket 54 extending around the inside of door 20 can be compressed to seal the door tightly against the frame.

In general, the access door includes a double-layered inner wall 56, 58 and an outer wall 60. A first peripheral wall 62 extends parallel to frame 50 between inner wall portions 56 and 58. Similarly, a second peripheral wall 64 extends parallel to frame 50 between inner wall portion 58 and outer wall 60.

Peripheral wall 62 is dimensioned to fit conformably inside frame 50. Peripheral wall 64 is dimensioned for fit conformably around the outside of frame 50. Peripheral wall 64 overlaps peripheral wall 62 by a short distance to provide a channel extending around the margin of the inner side of the door for receiving sealing flange 52 when the access door is closed. Gasket 54 is positioned within this channel and fastened to inner wall portion 58 so that the gasket is compressed against flange 52 when the door is closed.

Inner walls 56, 58 are spaced apart to define an insulating airspace 66 bounded by peripheral wall 62. Outer wall 60 is spaced outwardly from inner wall 58 to provide an insulating airspace 68 bounded by peripheral wall 64.

A series of square or rectangular openings 70 are positioned at intervals all around wall 64. These openings admit ambient air into airspace 68 as indicated by arrows 72, 74 to internally convectively cool the outer wall and to heat such air. The ambient air enters airspace 68 via bottom and lower side openings, is warmed by heat radiated from wall 58, and flows convectively upwardly through openings along the top and upper portions of peripheral wall 64.

A pair of door handles 76, 78 protrude forwardly from the door near the door's upper opposite corners. Because the outer surface of the door is convectively cooled as described above, such handles can be made of wood without risk of their being scorched or charred. Each handle has a rotating shaft 80 extending through the door to a door latch 82. The latches are positioned to engage along the inner surface of frame 50 when the handles are rotated to a closed position. The door latches are adapted for pulling the door tightly against the door frame, compressing seal 54, to form an air-tight closure of the access opening.

Hinges 48 include axially aligned horizontal hinge openings 83 for receiving hinge pins 85 to pivotally connect the door to the front wall of the firebox. Such hinges allow the door to be opening downwardly, in the direction of arrow 86, to provide easy access to the firebox.

FIG. 4 shows a preferred construction of firebox door 20. The door includes a rectangular frame 88 having parallel opposite sides forming peripheral side wall 64. Openings 70 are formed in the sides of frame 88. At opposite lower corners of frame 88 are aligned openings 83 for receiving hinge pins 85.

A first rectangular pan 90, having parallel opposite side walls 92 conforming to the inner dimensions of frame 88, fits snugly into one side of frame 88, side walls 91 being directed toward, but not obstructing openings 70. A second pan 92, substantially identical to pan 90 but having hinge openings **83*a* at its lower corners is fitted into frame 88 from the opposite side. The side walls 93 of pan 92 are directed in the same direction as side walls 91 of pan 90. Pans 90 and 92 form walls 60 and 58, spaced apart to define airspace 88**.

Juxtaposed within pan 92 is a third pan 94 having parallel opposite side walls 95 spaced inwardly of side walls 93. The bottom of pan 94 forms wall 56 and the side walls 95 form peripheral wall 62, which together with the bottom of pan 92 enclose dead airspace 66. Gasket 54 is sized to conform to the outer dimensions of pan 94 and to fit inside the channel between walls 93 of pan 92 and walls 95 of pan 94.

Aligned circular holes 96, 98 extend through pans 90, 92, 94, respectively, for receiving door handle shafts 80.

Stove Construction

Referring to FIGS. 5 and 6, stove 10 includes a firebox 100 contained within the walls of the jacket and spaced inwardly therefrom to define a surrounding airspace as described hereinafter.

Firebox 100 has parallel opposite side walls 102, 104 extending vertically from bottom wall 30 to support the firebox thereon. The firebox side walls 102, 104 are parallel to and spaced inwardly of jacket side walls 24, 26, respectively, to define side airspace portions 106, 108.

The firebox also has upper and lower firebox walls 110, 112. Upper wall 110 extends horizontally between the upper edges of walls 102 and 104, and is spaced downwardly from jacket top wall 22 to define an upper airspace portion 114. An inner flue collar 32*a*, concentrically positioned below outer collar 32, extends vertically between wall 22 and wall 110 to form a continuation of flue opening 34. Firebox bottom wall 112 extends horizontally between side walls 102 and 104 at a position spaced above jacket bottom wall 30 to define a lower airspace portion 116.

The firebox also has a rear wall 118 extending from side to side between the rearward edges of side walls 106 and 108, and exending vertically between the rearward edges of upper wall 110 and lower wall 112. Rear wall 118 is spaced inwardly of the rear fire jacket wall 28 to define a rear airspace portion 120.

Firebox front wall 46 extends vertically between the top and bottom jacket walls 22, 30, as described above. The frontal edges of the firebox side walls 102, 104 are connected to the lateral edges of the firebox front wall 46. The frontal edges of the firebox upper and lower walls 110, 112 are also connected to the front firebox wall 46. Front firebox wall 46 is not fully jacketed, as in the case of all the other firebox walls. However, door 20 forms an effective jacket over the central portion of wall 46. Additionally, wall 46 is inset from frontal extensions 122, 124 of the jacket side walls and from a combustion air manifold wall 126 which extends horizontally along the lower margin of wall 46. Wall 46 is thus effectively shielded by the cooler outer surfaces of the door 20, jacket portions 122, 124 and manifold wall 46.

An intermediate jacket or heat baffle extends around the side and rear walls of the firebox within the rear and side walls of the jacket. Referring to FIGS. 5 and 8, the baffle includes vertical side portions 128, 130 extending rearwardly from vertical air outlet openings 38, 40. Such portions are spaced a short distance inwardly of the jacket side walls 24, 26 to subdivide side airspace portions 106, 108 into inner and outer portions 106*a*, 106*b*, and 108*a*, 108*b*, respectively. Similarly, referring to FIGS. 6 and 8, a vertical rear portion 132 of the heat baffle extends from side to side between the rearward edges of portions 128, 130. Portion 132 is spaced inwardly from rear wall 20 to subdivide airspace portion 120 into an inner portion 120*a* which communicates with inner air space portions 106*a*, 108*a*, and outer portion 120*b* which communicates with outer airspace portions 106*b*, 108*b*. The upper edge of the baffle is spaced a short distance below jacket upper wall 22 and its lower edge is spaced above bottom wall 30 so that air can flow into both the inner and outer portions of the airspace. The inner surface of the heat baffle is heat-reflective so as to retain most of the heat radiating from the surface of the firebox side and rear walls within the inner portions of the airspace.

Inside the firebox is a cast iron refractory, best seen in FIGS. 6 and 8. The refractory includes vertical side walls 140, 142 having their lower edges supported on bottom firebox wall 112. Such walls extend upwardly approximately one-half of the distance to top wall 110 to shield the welded sheet metal firebox side walls from direct contact with the flames and hot coals of fire F. Similarly, cast iron wall segments 114*a* and 144*b* extend vertically along the lower half of the rear wall of the firebox to protect such wall from the fire. Two grates 146*a*, 146*b* are supported by legs 148 a sufficient distance above the bottom wall of the firebox to provide an airspace 150 beneath the grate for admitting combustion air. Multiple rows of inverted conical openings 152 extend through each of the grates to admit air from combustion airspace 150 into the firebox.

The refractory also includes inclined front walls 154*a*, 154*b* extending across the front of the firebox between the frontal edges of grates 146*a*, 146*b* and firebox front wall 46. Walls 154*a*, 154*b* are supported on the firebox bottom wall 30 by integral legs 156 to provide a combustion airway beneath such walls. The front walls lean diagonally against front wall 46 at a position just below door frame 50 and thereby define a plenum 158 along the front of the grate. Combustion air entering the plenum is heated by contact with the front walls prior to flowing beneath the grate.

A horizontal flame baffle 160 is positioned in an upper portion of the firebox, as shown in FIGS. 5 and 6. The flame baffle includes a removable rectangular baffle plate extending forwardly from a rear support 162 mounted on the rear firebox wall to a front support 164. Support 164 extends downwardly from upper wall 110 at a position spaced a short distance rearwardly of front wall 146. The baffle supports are centered between the firebox side walls 102, 104 so as to center the baffle beneath the flue opening 34. The baffle is spaced below upper wall 110 and extends laterally toward the side walls to generally obstruct the upward flow of hot gases and smoke from fire F. The lateral edges of the baffle are spaced a short distance inwardly of side walls 102, 104 to provide a tortuous pathway for the smoke and hot gases around the lateral edges of the baffle, against the upper portions of the firebox side walls and along upper wall 110.

Referring now to the lower portion of the stove, the pedestal 14 is connected to jacket bottom wall 30 along its upper periphery and to platform 16 along its lower periphery. Platform 16 is a large rectangular plate having its margins turned down to form a vertical flange 172 which spaces the plate 170 slightly above the floor 174 and provides an airspace 176 therebetween. The length of the platform are approximately equal to the length and width of the jacketed firebox. A rectangular opening 178 extending through the platform into the pedestal is adapted for connection to an outside combustion air duct 180 positioned in the floor beneath the stove.

The pedestal has sheet metal front and side walls 182, 183, 184 and a perforated rear wall 186. An outside combustion air conduit 188 extends vertically along front wall 182 from opening 178 to an opening 190 in jacket bottom wall 30. A laterally extendig wall 192, having a zig-zag vertical cross-section, extends between the firebox lower wall 112 and jacket bottom wall 30 immediately rearwardly of conduit 188. Walls 126 and 192 define a combustion air manifold 194 extending along the front of the firebox. Referring to FIG. 6, manifold 194 has a generally L-shaped cross-section, the vertical portion of which is defined by the lower margin of firebox wall 46 and wall 126.

The lower margin of front wall 46 is perforated along its width to provide a horizontal row of combustion air openings 196. Such openings allow outside combustion air to flow from manifold 194 into plenum 158 to be warmed before passing beneath the grate into the firebox.

A damper mechanism controls the rate of flow of combustion air through openings 196. The damper mechanism includes a handle 197 protruding from the front of the combustion air manifold. Connected to handle 197 is a perforated slide member 198 superposed over the perforated lower margin of front wall 46.

In case outside combustion air is not available in a particular installation, ambient combustion air can also be admitted to manifold 194 via a rectangular opening 200 in bottom wall 130 just forwardly of pedestal front wall 182. Opening 200 is provided with a removable cover 202.

Housed within the central portion of the pedestal is a blower 204. The blower is connected to a rectangular opening 206 approximately centered in jacket bottom wall 30 for discharging air into lower airspace portion 116. A solid state blower speed control 208 is electrically connected to the blower for turning the blower on and off and for varying its speed. The speed control is positioned inside the pedestal along wall 183 with its control knob 210 protruding through the wall.

OPERATION

Stove 10 is preferably positioned in a room to be heated so as to make best use of its sidewardly-directed hot air outlets. The stove is preferably centered along one wall of the room. However, the stove can also be positioned near a corner of the room. If so, it is preferably positioned diagonally across the corner with its access opening facing toward the inside of the room and with its warm air outlets directed obliquely along the walls. It is also preferable to provide an outside air conduit 180 in the floor beneath the stove.

The National Fire Protection Code requires a three-eighths inch sheet of asbestos or some other material of equivalent insulating value to be positioned on the floor beneath and around the stove to protect the floor from sparks when the access door is opened. Because of the relatively cool surface temperatures of the stove, described hereinafter, further floor insulation is unnecessary.

The National Fire Protection Code also requires that the stove be positioned so that the flue pipe 36 is at least eighteen inches from any adjacent wall. With the stove positioned to meet this requirement, the rear surface of the stove will ordinarily be at least fifteen inches away from any adjacent wall. At such a distance it is unnecessary to provide the wall with any additional shielding to meet National Fire Protection Code requirements, although local code regulations may require otherwise.

Once installed, wood stove 10 is operated in substantially the same manner as conventional wood stoves. A fire is built on the grate and the access door is closed and latched. Initially the damper mechanism is positioned to provide maximum air to the fire to get the fire started. Once the fire is burning adequately, the damper mechanism is adjusted to reduce the combustion airflow to approximately $\frac{1}{2}$ to $\frac{3}{4}$ of maximum and the blower is turned on by turning knob 210.

Outside combustion air flows upwardly from duct 180 through conduit 188 into manifold 194 as indicated by arrows 220. In the manifold, the air is warmed by contact with wall 192 and then flows through the openings in damper slide 198 and openings 196 into plenum 158, as indicated by arrow 222. From the plenum the air circulates beneath the grate, being further warmed, and then flows upwardly through openings 152, as indicated by arrows 224, to support combustion within the firebox.

Smoke and hot gases rising from fire F rise toward baffle 160. A portion of such gases flow forwardly and upwardly around the frontal edge of the baffle plate as indicated by arrows 226. Such gases then flow toward flue opening 34, heating upper wall 110 as they pass. Other portions of the gases are deflected laterally, as indicated by arrows 228, around the lateral ends of baffle 160. Such gases flow upwardly along upper portions of firebox side walls 102, 104 and then inwardly along lateral portions of upper wall 110 toward flue opening 34. In this way, the gases heat the firebox walls to a substantially higher temperature than if the gases were allowed to flow directly upwardly to the flue opening.

At the same time, blower 204 induces ambient room air into the pedestal through the pedestal's perforated rear wall 186. Such air is expelled upwardly into the lower portion of the airspace and flows laterally and rearwardly, as indicated by arrows 230. Such air flows along the bottom wall 112 of the firebox and is gradually warmed by contact therewith. At the rear of the firebox the air is released from confinement between firebox side walls 102, 104 into rear airspace 120.

The air flowing from beneath the central portion of the firebox flows upwardly through airspace 120 along the back wall of the firebox. Such air is divided between the inner and outer portions **120*a*, 120*b* of the airspace, as indicated by arrows 232*a* and 232*b*, respectively. Because the inner portion of the airspace is wider than the outer portion, most of the air flows between the reflective heat baffle and the firebox. At the top of the airspace the inner and outer airflows rejoin, as indicated by arrows 234*a*, 234*b*. This combined airflow then flows forwardly through the upper airspace along upper wall 110. There, the air is further heated by exposure to even hotter portions of the firebox. It is then expelled from the airspace through horizontal outlet openings 42, 44, as indicated by arrows 236**.

The air flowing from each of the lateral sides of lower airspace portion 116 flows laterally in the rear airspace portion toward the adjacent side airspace portion and is divided by the heat baffle, as indicated by arrows **238*a*, 238*b*. The air flowing through the inner airspace portions 106*a*, 108*a* flows upwardly and forwardly along the side walls of the firebox to be progressively heated by contact with increasingly hotter regions of such walls. Most of this air then flows forwardly and sidewardly out of the vertical openings 38, 40, as indicated by arrows 240. The remainder flows from the airspace through openings 42, 44. The air flowing through the outer airspace portions 106*b*, 108*b* flows upwardly, insulating the jacket side walls from the hot air in the inner airspace. This air then flows outwardly into the room via openings 42, 44**, together with the air heated in the upper airspace.

From the foregoing, it should be apparent that, with the blower off, air will flow convectively through the airspace in substantially the manner described above.

The air drawn upwardly through the pedestal into the firebox and airspace cools the pedestal and the underlying floor. During normal operation of the stove, floor temperatures are less than 10° F. below ambient temperatures. Similarly, the air flowing through the airspace, together with the reflective heat baffle, keeps the jacket of the stove relatively cool. Surface temperatures during normal operation of the stove are 150°–160° F., cool enough to avoid injury to one who inadvertently touches the stove. Temperatures at a distance of 15 inches from the stove, during normal operation are less than 65° F. below ambient temperatures along the side walls and less than 85° F. below ambient temperatures along the rear wall. Door handle temperatures are about 150° F., cool enough to manipulate with bare hands.

Underwriters Laboratories require that wood stoves be tested for certification under worst case conditions, that is, with hot-burning dry wood, the blower off, and the damper wide open. Even under these conditions, the stove remains relatively cool. Temperature rises above ambient are less than 75° F. and 100° F. 15 inches from the side and rear walls and less than 10° F. at the floor. Door handle temperatures rise to 250° F., too hot to touch but not hot enough to be scorched. Thus, the stove can be safely placed as closely as 15 inches from adjacent combustible wall surfaces without further shielding. Expensive floor shielding is also unnecessary.

Having shown and described a preferred embodiment of my invention, it should be apparent to those skilled in the art that modifications can be made without departing from the spirit of the invention. Accordingly, I claim all modifications falling within the scope of the following claims.

I claim:

1. In a wood stove having a firebox which includes a frontal access opening and a door adapted to close said frontal access opening, a door comprising:

inner and outer walls spaced apart to define a door airspace; and a peripheral wall interconnecting said inner and outer walls thereof in spaced-apart parallel relationship to define said door airspace;

said peripheral wall having upper and lower air openings for admitting ambient air to flow vertically through said door airspace to internally convectively cool said outer wall;

said inner wall of said door including a double-layered portion spaced inwardly from said peripheral wall surrounded by perimeter sealing means for sealing said inner wall against said frontal access opening of the stove, said double-layered portion protruding oppositely of said outer wall so as to fit within said opening, said double layers of said inner wall being spaced apart to define a second airspace.

2. The wood stove of claim 1 wherein:

said peripheral wall of said door comprises a flat elongated member having a row of openings extending along its length and having its ends connected together to define a closed geometric figure conforming to the shape of said frontal access opening;

said outer and inner walls comprising first and second pans, respectively, having outer rims conforming to the inner dimensions of said peripheral wall;

said pans being received within said peripheral wall on opposite sides of said openings.

3. The wood stove of claim 2 in which said outer rims are both directed away from said outer wall, said second pan having an outer rim sized to overlap a flange defining a door frame around said access opening of said firebox; and including a third pan having an outer rim connected to said second pan on a side opposite said first pan to define said double-layered portion, said outer rim being spaced inwardly of said second pan rim so as to fit within a door frame around said access opening.

4. The wood stove of claim 1 wherein the stove includes an outer jacket surrounding the firebox and defining an air space therebetween, and means for admitting ambient air into the air space to be heated by the firebox and for discharging the heated air from the air space to cool said outer jacket.

* * * * *

UNITED STATES PATENT AND TRADEMARK OFFICE

CERTIFICATE OF CORRECTION

PATENT NO. : 4,422,436

DATED : December 27, 1983

INVENTOR(S) : JOSEPH G. CHAMBERLAIN

It is certified that error appears in the above-identified patent and that said Letters Patent are hereby corrected as shown below:

Column 6, line 52, "92" should be --91--;

Column 6, line 60, "88" should be --68--;

Column 7, line 28, "exending" should be --extending--;

Column 7, line 47, "46" should be --126--;

Column 8, line 11, "114a" should be --144a--; and

Column 8, line 66, "extendig" should be --extending--.

Signed and Sealed this

*Third* Day of *April 1984*

[SEAL]

*Attest:*

GERALD J. MOSSINGHOFF

*Attesting Officer*

*Commissioner of Patents and Trademarks*